US005377567A

United States Patent [19]

Sorensen

[11] Patent Number: 5,377,567

[45] Date of Patent: Jan. 3, 1995

[54] BICYCLE TOOL

[75] Inventor: Joseph A. Sorensen, Lincoln, Nebr.

[73] Assignee: Petersen Manufacturing Co., Inc., DeWitt, Nebr.

[21] Appl. No.: 156,962

[22] Filed: Nov. 23, 1993

Related U.S. Application Data

[63] Continuation of Ser. No. 5,943, Feb. 4, 1993, abandoned.

[51] Int. Cl.[6] ..... B25B 13/08

[52] U.S. Cl. ..... 81/426; 81/367

[58] Field of Search ..... 81/426, 418, 424.5, 81/426.5, 367, 368

[56] References Cited

U.S. PATENT DOCUMENTS

| | | | |
|---|---|---|---|
| D. 260,476 | 9/1981 | Knaus . | |
| 389,666 | 9/1988 | Reagan . | |
| 685,215 | 10/1901 | Magui . | |
| 816,278 | 3/1906 | Tracht . | |
| 928,849 | 7/1909 | Carlson . | |
| 1,340,092 | 5/1920 | Tuscher, Jr. . | |
| 1,489,458 | 4/1924 | Petersen . | |
| 1,709,794 | 4/1929 | Konzelman . | |
| 2,212,801 | 8/1940 | Torbert . | |
| 2,471,606 | 5/1949 | Burns . | |
| 2,558,440 | 6/1951 | Johnson . | |
| 2,561,682 | 7/1951 | Barnett . | |
| 2,885,758 | 5/1959 | Russo et al. . | |
| 3,192,804 | 7/1965 | Petersen et al. . | |
| 3,195,382 | 7/1965 | Rommel et al. . | |
| 3,336,825 | 8/1967 | Cashion . | |
| 3,635,107 | 1/1972 | Schmidt . | |
| 3,894,451 | 7/1975 | Putsch . | |
| 4,014,226 | 3/1977 | Karamarkovich . | |
| 4,079,765 | 3/1978 | Hatayan . | |
| 4,145,793 | 3/1979 | Berlet . | |
| 4,472,986 | 9/1984 | Gottlieb . | |
| 4,505,011 | 3/1985 | Dupuy . | |
| 4,534,246 | 8/1985 | McNulty . | |
| 4,541,312 | 9/1985 | Petersen . | |
| 4,546,680 | 10/1985 | Petersen . | |
| 4,709,601 | 12/1987 | Petersen . | |
| 4,730,524 | 3/1988 | Petersen . | |
| 4,989,479 | 2/1991 | Anderson et al. . | |
| 5,007,312 | 4/1991 | Bailey | 81/426.5 |
| 5,095,783 | 3/1992 | Majima | 81/165 |
| 5,101,530 | 4/1992 | Hansen et al. | 30/172 |

FOREIGN PATENT DOCUMENTS

| | | | |
|---|---|---|---|
| 0357490 | 3/1990 | European Pat. Off. . | |
| 1232020 | 10/1960 | France . | |
| 2125796 | 9/1972 | France . | |
| 2227930 | 11/1974 | France | 81/426.5 |
| 2903252 | 9/1980 | Germany . | |
| 796846 | 6/1958 | United Kingdom . | |
| 2234701 | 2/1991 | United Kingdom . | |
| 82/03042 | 9/1982 | WIPO . | |

OTHER PUBLICATIONS

Hex Lock Advertisement, published by the Hex Lock Company, publication date unknown.

Mac Tools Adveretisement of Vise Grip Pliers (TM), published by Mac Tools, publication date unknown.

Plier/Wrenches & Strap Wrenches Advertisement, published by McMaster Carr, publication date unknown.

Multi-Grip Adjustable Wrench Advertisement, puslished by McMaster Carr, publication date unknown.

"Vise-Grip Quick Grip Prosnip Unibit Chesco Catalog," published by American Tool Companies, Inc., published 1993, pp. 1-9.

"General Program '92GB," published by Beta Utensili, published 1992.

"Ihr Werkzeugparetner D92," published by Gedore, published 1992, p. 111.

"Grip-On Catalog," published by Grip-On, publication date unknown.

"Llaves Grip Catalog," published by Zarley, publication date unknown.

"Irimo-1a herramienta," published by Irimo, publication date unknown, p. 99.

"Programm-Information," published by Urbo, publication date unknown, pp. 1-4.

"Outillage Roux France Catalog," published by Outillage Roux France, publication date unknown, pp. 1-4.

Exhibit A, Hand Tool A shown in photograph, manufactured by Petersen Manufacturing Co. of DeWitt, Nebraska and was in existence on or before Oct. 1991.

Exhibit A, Hand Tool B shown in photograph, manufactured by J. L. Behmer Corp. of Perkasia, Pennyslvania and was in existence on or before Oct. 1991.

*Primary Examiner*—D. S. Meislin
*Attorney, Agent, or Firm*—Willian Brinks Hofer Gilson & Lione

[57] ABSTRACT

A locking plier hand tool contains first and second jaw elements, wherein each jaw element has a forward end and a rear end. The first jaw element has a main recess formed by first and second contacting portions positioned at an angle to each other and a third contacting portion interconnecting the first and second contacting portions. Each first and second contacting portions has one end connected to the third contacting portion and a free end. The second jaw element is provided with an arc shaped protuberant extending outwardly in the direction of the main recess. A substantially flat member contains at least a rear part and extends between the free end of the second contacting portion of the main recess and the rear part. A substantially flat surface extends rearwardly from the protuberant. A wall is situated remotely to the protuberant. The wall has a free end substantially in engagement with the rear part of the substantially flat member when the hand tool is in the closed position. The protuberance, the wall and the substantially flat surface form an auxiliary recess offset to the main recess. This auxiliary recess restricts the workpiece while the hand tool is in the substantially open position.

14 Claims, 2 Drawing Sheets

FIG. 1
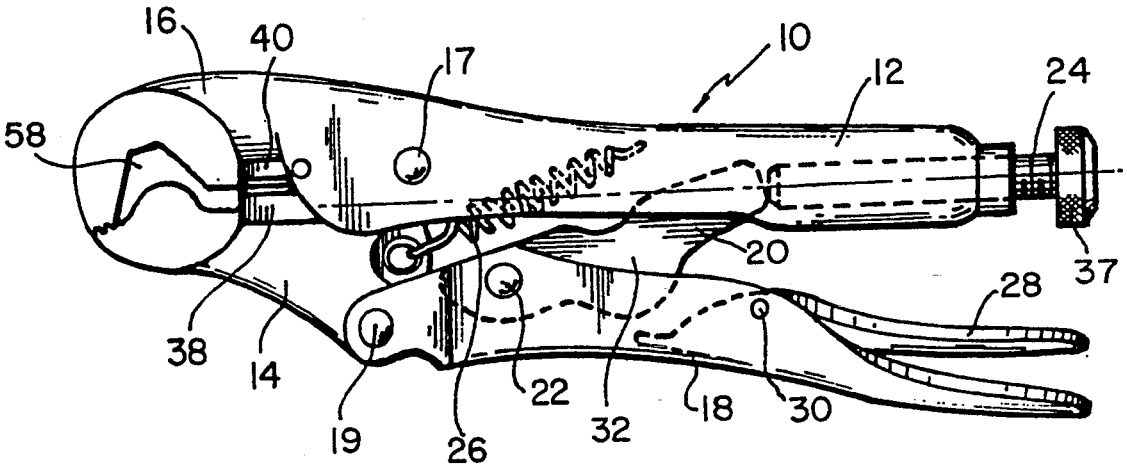
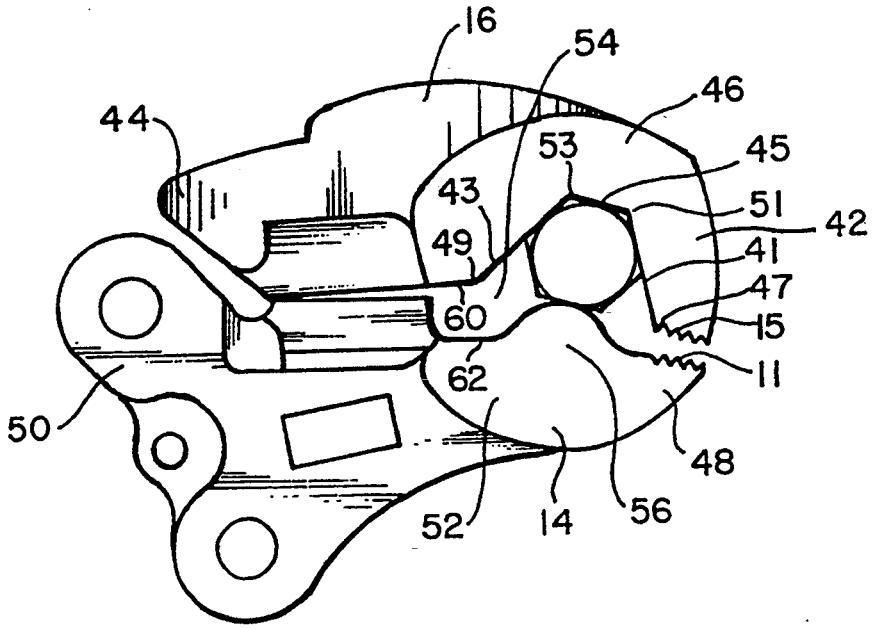
FIG. 2

BICYCLE TOOL

This application is a continuation of application Ser. No . 08/005,943, filed Feb. 4, 1993 now abandoned.

FIELD OF THE INVENTION

This invention relates to hand tools and more specifically relates to a hand tool such as locking pliers adapted for adjustment of a variety of fasteners which are part of a bicycle, and which can be used as a spoke wrench to adjust spokes of a bicycle wheel.

BACKGROUND OF THE INVENTION

The recent explosion of the bicycle industry substantially increases the demand for a universal hand tool which fits a variety of hex-type and other fasteners and which also can be used to adjust spokes of the bicycle wheels. The fasteners that are used by the manufacturers of conventional bicycles come in a great many sizes and configurations. Therefore, when conventional hand tools such as locking pliers and adjustable wrenches are used to adjust such fasteners, the teeth of such hand tools continuously strip the exterior of the fastener. Since it is difficult, if not completely impossible, to continuously use the stripped fasteners, their replacement becomes necessary. Such drawback, in addition to a substantial inconvenience, increases the cost of the maintenance and in the long run might reduce the life span of the bicycle. Furthermore, conventional hand tools or locking pliers are typically bulky and can not be kept in a storage compartment of the bicycle. Still further, conventional locking pliers can not be used for adjustment of spokes of the bicycle wheels and use of a separate spoke wrench becomes necessary.

Therefore, there is a need for a single universal hand tool having jaws which are especially configurated to provide firm gripping action on workpieces of various shapes and which tool could be used for adjustment of different types of fasteners without deforming and destroying them. There is also a need for a universal tool adapted to fit metric, english, and other types of fasteners; the tool which is capable of replacing a set of wrenches, includes a wire cutter, and could be utilized as a spoke wrench.

BRIEF DESCRIPTION OF THE DRAWINGS

Other advantages and features of the invention are described with reference to exemplary embodiments, which are intended to explain and not to limit the invention, and are illustrated in the drawings in which:

FIG. 1 is side elevational view showing a locking plier hand tool or bicycle tool according to the invention;

FIG. 2 is an enlarged partial view of the bicycle tool showing jaw elements in a semi-closed position;

DESCRIPTION OF THE PREFERRED EMBODIMENTS

Figure 3:
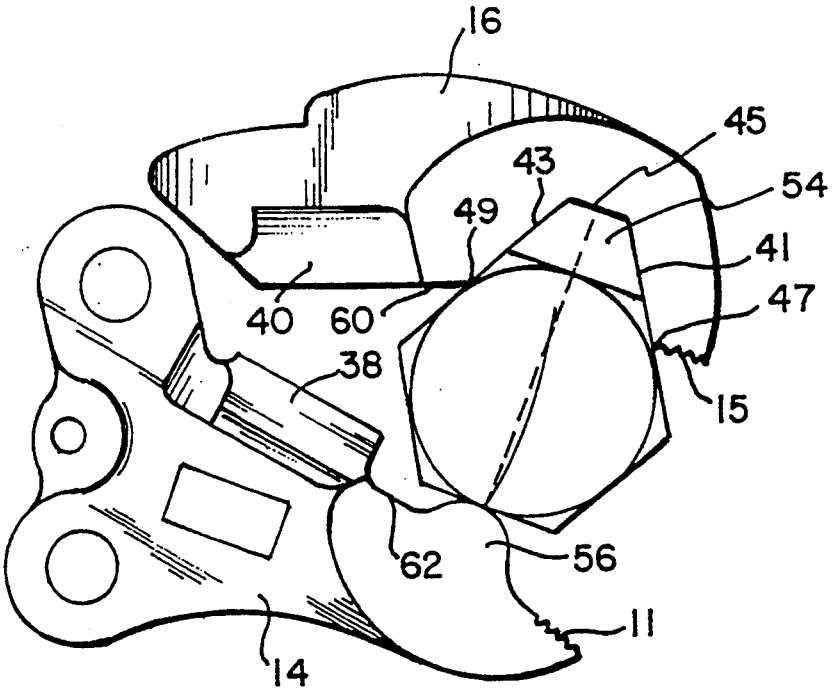
FIG. 3 is an enlarged view showing the jaw elements of the bicycle tool in an open position.

Although specific embodiments of the invention will now be described with reference to the drawings, it should be understood that the embodiments shown are by way of example only and merely illustrative of but a few of many possible specific embodiments which can represent applications of the principles of the invention. Changes and modifications, obvious to one skilled in the art to which the invention pertains, are deemed to be within the spirit, scope, and contemplation of the invention as further defined in the appended claims.

As best shown in FIG. 1, the locking plier hand tool or the bicycle tool is generally designated by the reference numeral 10, and includes a stationary handle member 12, and a lower movable clamping member or second jaw element 14. The handle member 12 is provided with an upper stationary clamping element or first jaw element 16. A toggle mechanism comprises an elongated handle member 18 and a toggle-link member 20 which is conventionally pivotally engaged at one end about the pin 22. The other free end (shown in phantom) of the toggle-link member 20 is engaged with the handle member 12, and in particular the abutment end (also shown in phantom) of an adjustment screw member 24 which is suitably threadably engaged at the end of the handle member 12. The forward end of the handle member 18 is preferably bifurcated or forked, and a corner portion of the movable jaw element 14 is suitably disposed within the fork or between the bifurcation arms by pivot pin means 19. Similarly, the handle member 12 is preferably channel-shaped, and receives another corner portion of the movable clamping element 14 which is also suitably secured thereto by means of a pivot pin 17.

Spring means 26, preferably in the form of a tension coil spring, is secured between the handle member 12 and the movable clamping element 14 or lower jaw, to urge the clamping element 14 away from the stationary clamping element when the jaws are opened.

An elongated release lever 28 is suitably pivotally mounted by means of a pin 30, to the inside of the handle member 18, and is provided with a forwardly extending portion (as shown in phantom) and is engagable with a projection 32 of the toggle-link member 20 which extends toward the handle member 18. When the release lever 28 is pivoted about the pin 30, the handle member 12 is moved away from the handle member 18.

As best shown in FIGS. 2–3, the inner faces of the front portions of the jaw elements are formed with limited serrated or toothed gripping surfaces 11 and 15. The gripping surfaces oppose each other so that when the front portions of the jaws are engaged with a workpiece, for example a cable of a bicycle, the latter will be securely and firmly gripped by the surfaces 11 and 15 of the jaws of the invented tool.

It will be appreciated that the wrench or locking pliers mechanism and toggle construction described herein, with some exceptions, conforms basically in accordance with the construction described in U.S. Pat. No. 1,489,458 which is incorporated by reference by the present application. Furthermore, such construction, the operation thereof, and the specific operation of the release lever is clearly set forth in U.S. Pat. No. 3,192,804 also incorporated by reference. As explained in these prior art patents, closing of a locking wrench or pliers incorporating a toggle device is effected by moving the movable handle member 18 toward the fixed handle member 12. This movement forces the upper end of the toggle-like member 20 to move inwardly towards the handle member 212. The pivot pin 22 also moves inwardly, and when such pivot pin moves over center, the pliers is locked in a closed position.

The fixed handle can be formed as a U-shaped channel. The end of the fixed handle, remote from the fixed jaw 16, is completed with a receiving portion. A threaded opening extends through the receiving portion. A screw member 24 is provided for threadable engagement with the threaded opening. The screw terminates in a knurled adjusting knob 37 at one end and the contacting part at the other end.

When the screw member 24 is turned at the knob by the user, its rotation within the threaded opening results in advancement of the screw in the axial direction. Such advancement in the direction of the fixed jaw 16 presses the contacting part against the toggle-link 20 and changes the distance between the end of the toggle link and the pivot point of the movable jaw 14, whereby the distance between the stationary jaw 16 and the movable jaw 14 is adjusted to grip objects of different dimensions without exerting excessive force.

The configuration of the stationary and movable jaw elements is best illustrated in FIGS. 1–4. The stationary or the first jaw element 16 includes a forward end 42 and a rear end 44 with a central portion 46 positioned therebetween. Similarly, in the movable or second jaw element 14, a central portion 52 is situated between a rear end 50 and front end 48. A pair of handles is operatively connected to the first and second jaw elements for their movement toward and away from each other.

An engaging recess 54 extends inwardly within the central portion 46 of the first jaw element. The recess is formed by first 41 and second 43 contacting portions positioned at an angle to each other, with a third contacting portion 45 situated therebetween. The first and second contacting portions each having one end 51 and 53 (correspondingly) connected to the third contacting portion and a free end 47 and 49 (correspondingly).

Figure 4:
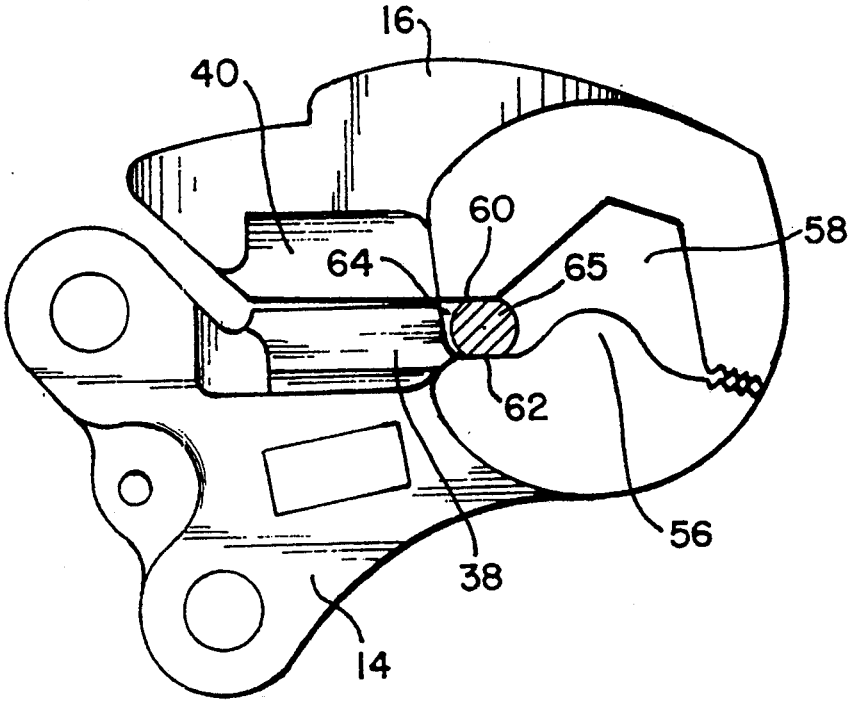
FIG. 4 is an enlarged view showing a closed position of the jaw elements.

In the movable jaw element, an arc shaped protuberant 56 extends outwardly from its central area 52 in the direction of the recess 54 of the stationary jaw element. FIGS. 1 and 4 best illustrate that in the closed position of the hand tool, a space 58 is formed between the protuberant and the recess.

When a workpiece, such as, for example, a hexagonal fastener is positioned within the recess 54 and the movable jaw element with the protuberant 56 is locked in the closed position, there are at least three points of contact provided between the fastener and the tool. FIG. 3 shows that these points of contact can be situated at the first, second contacting portions of the recess and the arc shaped protuberant.

A substantial advantage of the present invention over other tools used for repair of the bicycles (for example adjustable wrenches having substantially flat engaging jaws) is that the jaws of the wrench typically engage two points or surfaces of the fastener, whereas the hand tool of the invention engages at least three separate points or surfaces on the exterior of the fastener. Therefore, when the adjustable wrench of the prior art is used, in view of the limited engagement between the flat engaging jaws and the fastener, a substantial torque force applied to such limited areas of engagement will strip the metal from the exterior of the fastener at least in the places of such limited engagement. In the present invention the contact between the tool and the fastener is distributed to at least three surfaces of contact. Therefore, each surface accepts lesser torque and more evenly distributes stresses throughout the fastener. This in many instances prevents stripping of metal and reduces wear and tear on the fastener when the bicycle tool of the invention is used.

When the user applies force to the lower handle 18, the protuberant 56, through a limited contacting area applies pressure to one of the exterior surfaces of the fastener, so that the fastener could be slightly moved within the recess to enhance the engagement between the fastener and the stationary jaw element 16.

It is shown in FIG. 2 that when the bicycle tool 10 should be applied to a relatively small fastener, such fastener engages four surfaces such as: the first, second and third contacting portions of the recess 54 and the protuberant 56 of the second jaw element. As the user applies the pressure, the fastener might shift slightly within the opening 58 to insure a better engagement between the tool and the fastener.

Although specific configuration of the engaging elements such as the recess 54 of the stationary jaw element and the protuberant 56 of the movable jaw element have been discussed hereinabove, it should be understood that any suitable configuration of the recess and protuberant is within the scope of the invention.

FIGS. 2–4 best illustrate that in the stationary jaw element 16 a first substantially flat member or surface 60 extends rearwardly from the free end 49 of the second contacting portion of the recess. On the other hand, a second substantially flat member or surface 62 is provided rearwardly of the arc shaped protuberant 56. Such flat members 60 and 62 are arranged in such a manner that in a closed position of the tool (See FIG. 4), a gap 64 is formed between the movable and stationary jaws providing a wrench for adjustment of bicycle spokes.

In order to adjust a position of a spoke within a wheel of the bicycle, a portion 65 of the spoke is situated between the flat members 60 and 62 (See FIG. 4) and the lower handle 18 is moved to its closed position. The flat members 60 and 62 closely engage the exterior of the spoke. Longitudinally motion of the spoke 65 is also limited by the protuberant 56 and a side of a blade 38 of a cutter. Thus, the spoke is locked in the spoke wrench. Then, upon rotation of the hand tool the spoke is rotated within the hub of the wheel and therefore, adjusted.

The space 58 and the gap 54 can be adjusted by the user when the screw member 24 is turned at the knob 37 within the threaded opening. Such rotation results in advancement of the screw 24 in the axial direction thereof which eventually leads to the change in the distance between the stationary and movable jaws.

A conventional wire cutter is provided rearwardly of the spoke wrench comprising a lower blade 38 positioned at the inner portion of the movable jaw member 14 and an upper anvil 40 which is positioned at the inner portion of the fixed jaw member 16. The blade is suitably beveled as is conventional in the art.

A hand tool in which the wire cutter is formed by the lower anvil and upper blade is within the scope of the invention.

The hand tool of the invention is typically made from a heat treated steel. The hardness of the steel used for the manufacturing of the jaw elements can be in the range from about 53 to about 57 Rockwell C scale, with the jaw elements made from alloy steel having properties of desired strength and toughness, as well as the required flexibility. In another embodiment of the invention the hardness of the jaw elements can be in the range from about 54 to about 55 Rockwell C scale. Use of an oil-hardening alloy spring steel having relatively higher amounts of silicon and manganese than other plain carbon tool or alloy tool steels is also contemplated. It is known that below Rockwell 53, the steel is too soft and above Rockwell 57, the steel may be too fragile.

A person of ordinary skill in the field of hand tools should appreciate that a combination tool in which the jaw elements are made out of steel and the handles manufactured from plastic is within the scope of the invention. In such combination tools, the handles can be manufactured from glass reinforced polypropylene or glass reinforced nylon. Furthermore, use of carbon fiber or graphite reinforced plastics for making of the handles and/or toggle link member also form a part of the invention.

While the above-discussed materials used in manufacturing of the bicycle tool have been found suitable, it should be recognized that many other materials may be utilized, provided that they have desired characteristics.

In order to apply the bicycle tool 10 to a nut, or other similar workpiece, the required spacing between the movable jaw 14 should be first adjusted to an estimated spacing in relation to the fixed jaw 16. The tool is then applied to a fastener or nut and the lower handle 18 is moved toward the upper handle 12 and locked. If the spacing is too large, the over-center locking stationary mechanism does not function, or does not function positively, either fact being readily apparent to the workman. However, if the spacing is too small, the movable handle 18 cannot be closed all the way to the stationary handle 12. In this case, the handle 18 is open, and the spacing of the jaws is appropriately adjusted.

When the jaw spacing has been properly adjusted, a workpiece such as a hexagonal nut, for example, is positioned within the recess 54 of the stationary jaw element and the movable jaw element having the protuberant 56 is moved and locked in the closed position of the hand tool. If the tool is applied to a fastener having outside dimensions smaller than the recess 54, then as the force is applied to the fastener by the protuberant 56, the fastener might shift slightly within the recess to insure better engagement between the tool and the fastener. If the work space is confined, the wrench may be repeatedly clamped on the nut, turned a short distance, removed, and repositioned.

If adjustment of the position of the spoke within the wheel of the bicycle is required, a portion of the spoke near the hub of the wheel should be positioned between the flat members 60 and 62 of the upper and lower jaw elements. When the lower jaw element 14 is locked in the closed position, the flat members engage the exterior of the spoke. Rotation of the bicycle tool and the clamped spoke should be resulted with the adjustment thereof within the wheel.

The bicycle tool of the invention is capable of firmly gripping large as well as relatively small fasteners which are quite difficult to hold otherwise. It is seen from the foregoing description that the hand tool of the present invention is very compact and simple in construction. The tool has an adequate gripping range for a wide variety of fasteners and other items. Moreover, the shape of the gripping jaws insures a positive grip of the fastener without defacing its surfaces. The hand tool has a fairly wide gripping range to accommodate most of the fasteners used in the conventional bicycles, can be used as a spoke wrench, and a wire/cable cutter.

We claim:

1. A locking plier hand tool comprising:

a first jaw element having a forward end and a rear end;

a second jaw element having a forward end and a rear end;

a pair of handles operatively connected to said first jaw element and said second jaw element for movement of said first jaw element toward and away from said second jaw element from a substantially open position to a substantially closed position and vice versa;

said first jaw element having a central portion positioned between said forward and rear ends thereof, said central portion having a main recess formed by (1) a first contacting portion; (2) a second contacting portion at an angle with respect to said first contacting portion; and (3) a third contacting portion interconnecting said first contacting portion and said second contacting portion, wherein each of said first contacting portion and said second contacting portion having one end connected to said third contacting portion and a free end;

said second jaw element having a central area situated between said forward end and said rear end thereof, wherein an arc shaped protuberant extends outwardly from said central area toward said main recess;

said first jaw element comprising a substantially flat member having a rear part, said substantially flat member extending between said free end of said second contacting portion of said main recess and said rear part;

said second jaw element comprising a substantially flat surface extending rearwardly from said protuberant and a wall situated remotely from said protuberant, said wall extending from said substantially flat surface and having a free end substantially in engagement with said rear part of said substantially flat member when said hand tool is in said closed position;

said protuberant, said wall and said substantially flat surface forming an auxiliary recess offset to said main recess, so that a gap is formed between said substantially flat member and said substantially flat surface adapted to receive a workpiece when said first and second jaw elements are in said substantially closed position.

2. The locking plier hand tool according to claim 1, comprising an adjustment element for adjusting a spacing between said first and second jaw elements.

3. The locking plier tool according to claim 2, wherein said adjustment element includes a screw threaded into an end of one of said pair of handles at an end thereof opposite said first jaw element.

4. The locking plier hand tool according to claim 3, wherein said one of said pair of handles is fixedly connected to one of said first and second jaw elements, wherein an axis of said screw is offset from one side of said one of said first and second jaw elements and is pointing toward another of said first and second jaw elements.

5. The locking plier hand tool according to claim 2, wherein said gap can be adjusted by said adjustment element.

6. The locking plier hand tool according to claim 1, wherein said first jaw element is a stationary jaw element and said second jaw element is a movable jaw element and said recess is positioned within said stationary jaw element, whereas said protuberant is a part of said movable jaw element.

7. The locking plier hand tool according to claim 6, wherein a space is formed between said recess and said protuberant when said hand tool is in said substantially closed position.

8. The locking plier hand tool according to claim 1, wherein said pair of handles is made from glass reinforced polypropylene or glass reinforced nylon.

9. The locking plier hand tool according to claim 1, wherein said pair of handles is made from carbon fiber or graphite reinforced plastic.

10. The locking plier hand tool according to claim 1, wherein said wall is situated transversely to said substantially flat surface.

11. The locking plier hand tool according claim 10, wherein said wall is positioned at a right angle to said substantially flat surface.

12. The locking plier hand tool according to claim 1, wherein a cutter formed by at least a cutting blade on one of said first and second jaw elements is situated rearwardly of said auxiliary recess.

13. The locking plier hand tool according to claim 12, wherein said cutting blade extends rearwardly from said free end of said wall.

14. The locking plier hand tool according to claim 13, wherein said cutter further comprises an anvil on one of said first and second jaw elements extending rearwardly from said rear part of said substantially flat member.

* * * * *